US012774148B2

(12) United States Patent
Bradley et al.

(10) Patent No.: US 12,774,148 B2
(45) Date of Patent: Oct. 27, 2026

(54) COLD CHAIN RECYCLABLE PACKAGING

(71) Applicant: ORORA PACKAGING SOLUTIONS, Buena Park, CA (US)

(72) Inventors: Chris Bradley, Buena Park, CA (US); Alan Crarer, Santa Cruz, CA (US)

(73) Assignee: Veritiv Packaging Solutions, Buena Park, CA (US)

( * ) Notice: Subject to any disclaimer, the term of this patent is extended or adjusted under 35 U.S.C. 154(b) by 234 days.

(21) Appl. No.: 18/204,169

(22) Filed: May 31, 2023

(65) Prior Publication Data

US 2023/0382626 A1 Nov. 30, 2023

Related U.S. Application Data

(60) Provisional application No. 63/347,498, filed on May 31, 2022.

(51) Int. Cl.
*B65D 81/38* (2006.01)
*B65B 1/06* (2006.01)

(52) U.S. Cl.
CPC ..... *B65D 81/3823* (2013.01); *B65B 1/06* (2013.01)

(58) Field of Classification Search
CPC ..... B65D 81/3823; B65D 81/3825; B65D 81/3858; B65D 81/3862; B65D 65/466; B65D 81/18; B65D 81/3897; B65D 81/3853; B65D 25/16; B65D 81/3848; B65D 81/09; B65D 81/3818; B65D 5/248; B65D 5/566; B65D 5/58; B31D 5/0078; B32B 2250/26; B32B 2307/7163; B32B 29/00; Y02W 30/80
(Continued)

(56) References Cited

U.S. PATENT DOCUMENTS 11,511,927 B2 * 11/2022 Madanagopal .... B65D 81/3823
11,572,973 B2 * 2/2023 McGoff ..... B32B 29/02
(Continued)

FOREIGN PATENT DOCUMENTS

CN 116829329 A * 9/2023 ..... B29D 99/0092
GB 1272730 A * 5/1972 ..... B65B 61/22
WO WO-9954228 A1 * 10/1999 ..... B65D 65/46

*Primary Examiner* — Christopher R Demeree
(74) *Attorney, Agent, or Firm* — Martin & Ferraro, LLP

(57) ABSTRACT

Cold chain shipping containers insulated to transport temperature sensitive items such as food and pharmaceuticals, the containers preferably made of entirely recyclable materials to enable curbside recycling, materials used include, for example cardboard, corrugated cardboard, and cellulose insulation, with at least a portion of the materials preferably being made from postconsumer paper. Embodiments include an external and an internal box "box within a box" configuration with an insulation material being applied by filling equipment to inject or spray the insulation material into the gaps between the external box and the internal box; and external boxes with erectable insulation-filled panels in the form of self-erecting boxes, flat pack boxes, and tri-fold panels of self-erecting boxes or card stock. The insulation material being applied by filling equipment to inject or spray the insulation material into the interior of the panels. The insulation filling process can be automated and performed on an assembly line as part of the box manufacturing operation.

7 Claims, 5 Drawing Sheets

(58) Field of Classification Search
USPC ..... 229/103.11, 122.3, 122.34; 206/584, 206/521, 594; 220/592.2, 592.25, 592.01, 220/23.87, 560.14, 592.1, FOR. 138; 383/1; 62/457.1
See application file for complete search history.

(56) References Cited

U.S. PATENT DOCUMENTS

| | | | | |
|---|---|---|---|---|
| 12,091,233 | B2 * | 9/2024 | Melchor | B65D 81/3825 |
| 2020/0148453 | A1 * | 5/2020 | Sollie | B65D 81/3823 |
| 2022/0144525 | A1 * | 5/2022 | Amrutiya | B65D 81/051 |
| 2023/0251011 | A1 * | 8/2023 | Blezard | B65D 81/3858 62/529 |

* cited by examiner

COLD CHAIN RECYCLABLE PACKAGING

RELATED APPLICATION

This application claims the benefit of U.S. provisional patent application No. 63/347,498 filed May 31, 2022, incorporated by reference herein.

BACKGROUND

Cold chain shipping utilizes insulated packaging and containers to transport temperature sensitive items such as food and pharmaceuticals. Traditionally, such cold chain containers have been constructed entirely or partially from foam based materials, such as expanded polystyrene (EPS) and/or urethane, wherein the foam based materials generally provide insulation during transportation. Most foam based materials and/or products are not recyclable, at least not in the mainstream recycling readily accessible to consumers. Foam based materials and/or products usually are bulky and require a great deal of space to be shipped, which generally increases shipping costs. Other containers that are configured to transport temperature sensitive items may include a combination of materials, such as foam based materials and/or paperboard. Most containers of this nature are not recycled, because the materials generally must be separated from one another to be recycled in the mainstream. Moreover, these containers generally are not reused. Containers that are not recycled and not reused may end up in landfills, negatively impacting the environment. Additionally, some insulated containers use materials such as insulation that is very dense and carries significant weight penalties when shipped, which may increase the cost to ship the container.

There exists a need for a container that overcomes these and other drawbacks. Specifically, the cold chain shipping market has a long-felt desire for a fully recyclable alternative to expanded polystyrene coolers and urethane shippers that do not carry a weight or cost penalty.

SUMMARY

The present invention is directed generally to cold chain shipping containers that are insulated to transport temperature sensitive items such as food and pharmaceuticals. The containers preferably are made of entirely recyclable materials to enable curbside recycling. The materials of the containers are not required to be separated from one another to be recycled in the mainstream. Materials used include, for example cardboard, corrugated cardboard, and cellulose insulation, with at least a portion of the materials preferably being made from postconsumer paper.

Embodiments of the containers in accordance with the present invention include for example, a "box within a box" configuration with an insulation material being applied by filling equipment to inject or spray the insulation material into the gaps between an external box and an internal box. Embodiments of the containers also include external boxes with erectable insulation-filled panels in the form of self-erecting boxes, flat pack boxes, and tri-fold panels of self-erecting boxes or card stock. The insulation material being applied by filling equipment to inject or spray the insulation material into the interior of the panels. The insulation filling process can be automated and performed on an assembly line as part of the box manufacturing operation. The insulation material is 100% recyclable and is made of preferably 100% recycled material such as recycled paper pulp (cellulose) and preferably has an insulation R-value per inch in the range of approximately 3.1-3.8 for example, with an R-value of 3.8 being preferred. The insulation material can also include or be made of other recyclable materials without departing from the scope of the present invention.

In one embodiment, an insulated container for transporting temperature sensitive contents comprises an external box having sides, a top, and a bottom; and an internal box having sidewalls, a bottom, and extensions extending from the sidewalls, the sidewalls of the internal box surrounding an internal space for holding the contents, the internal box being sized and configured to be inserted and contained within the external box, wherein, when the internal box is inserted within the external box, gaps are present between the sides of the external box and the sidewalls of the internal box, and between the bottom of the internal box and the bottom of the external box, the gaps being filled with a loose-fill insulation material to create an insulated space surrounding at least a portion of the internal space of the internal box, the extensions of the internal box extending over the gaps between the side walls proximate the top of the external box.

In another embodiment, an insulated container for transporting temperature sensitive contents comprises an external box having sides, a top, and a bottom; and a plurality of insulated panels, each of the insulated panels having a top, a bottom, and spaced apart sidewalls defining an interior space therebetween, each of the insulated panels being sized and configured to be inserted and contained within the external box, the insulated panels having a fill access to access and fill the interior space, the interior space being filled with a loose-fill insulation material between the sidewalls, wherein, when the insulated panels are inserted within the external box, the insulated panels are arranged along the sides, top, and bottom of the external box, respectively, to create an insulated space defining a cargo hold for holding the temperature sensitive contents.

In another embodiment, a method for filling an insulated container for transporting temperature sensitive content with a loose fill insulation material, the method comprises providing an external box having sides, a top, and a bottom; inserting within the external box an internal box being sized and configured to be inserted and contained within the external box, the internal box having sidewalls, a bottom, and extensions extending from the sidewalls, the sidewalls of the internal box surrounding an internal space for holding the contents; positioning the internal box within the external box with gaps between the sides of the external box and the sidewalls of the internal box, and between the bottom of the internal box and the bottom of the external box; filling the gaps with a loose-fill insulation material to create an insulated space surrounding at least a portion of the internal space of the internal box; and positioning the extensions of the internal box to extend over the gaps between the sidewalls of and the sides proximate the top of the external box to cover at least a portion of the loose-fill insulation material within the gaps.

In another embodiment, a method for filling an insulated container for transporting temperature sensitive content with a loose fill insulation material, the method comprises providing an external box having sides, a top, and a bottom; inserting within the external box a plurality of insulated panels, each of the insulated panels being sized and configured to be inserted and contained within the external box, each of the insulated panels having a top, a bottom, and spaced apart sidewalls defining an interior space therebetween, the insulated panels having a fill access to access and fill the interior space; filling, through the fill access, the interior space with a loose-fill insulation material between the sidewalls of the insulated panels; and arranging the insulated panels along the sides, top, and bottom of the external box, respectively, to create an insulated space defining a cargo hold for holding the temperature sensitive contents.

The loose-fill insulation comprises recycled pulp. The loose-fill insulation is preferably a blow-in insulation that is blown into the gaps through a filling nozzle from a blow-in cellulose insulation machine.

The loose-fill insulation is a blow-in insulation and may include blowing the insulation into the interior space of the insulation panels through a filling nozzle from a blow-in cellulose insulation machine.

The loose-fill insulation preferably has an insulation R-value per inch in the range of approximately 3.1-3.8.

The insulated container can also include at least three of the insulated panels that are connected to form a tri-fold panel.

The insulated container can further include a filling port in the insulation panels, the insulation material being filled through the filing port and into the interior space of the insulated panels.

These and other examples of the present invention will be apparent from review of the following specification and the accompanying drawings.

BRIEF DESCRIPTION OF THE DRAWINGS

The accompanying drawings, which are included to provide further understanding of the present invention disclosed in the present disclosure and are incorporated in and constitute a part of this specification, illustrate aspects of the present invention and together with the description serve to explain the principles of the present invention. In the drawings.

DETAILED DESCRIPTION

The detailed description set forth below is intended as a description of various configurations of the present invention and is not intended to represent the only configurations in which the present invention may be practiced. It will be apparent, however, to those of ordinary skill in the art that the present invention is not limited to the specific details set forth herein and may be practiced without these specific details.

Referring to the Figures, examples of various embodiments of cold storage containers in accordance with the present invention are shown. Each of the various containers described herein is made with recyclable materials (preferably post-consumer materials) to be 100% curbside recyclable.

Figures 1A, 1B, 1C:
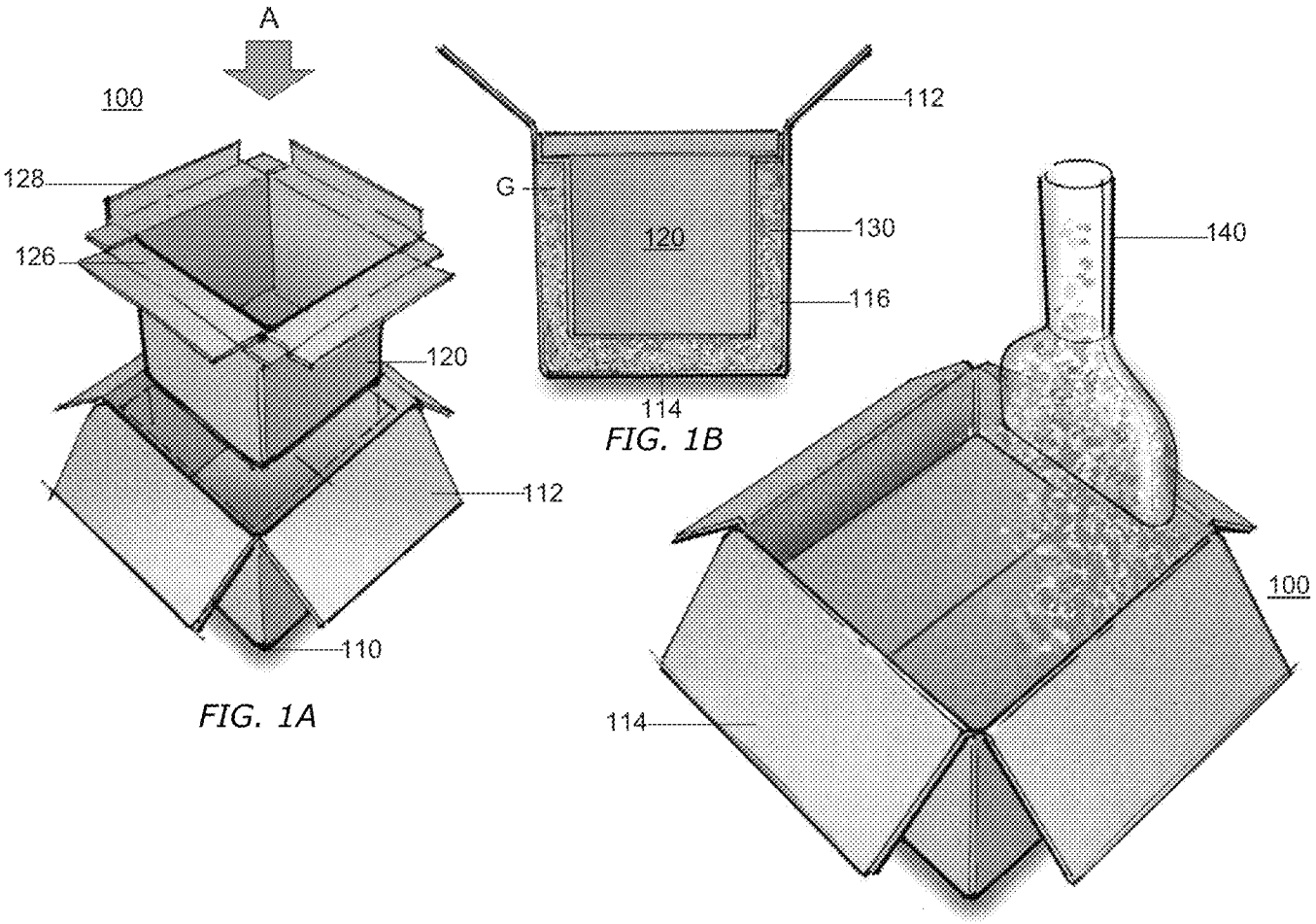
FIGS. 1A-1C show an embodiment of a cold storage container having a box within a box configuration and a method of filling thereof with an insulation material in accordance with the present invention.
Figures 2A, 2B, 2C, 2D:
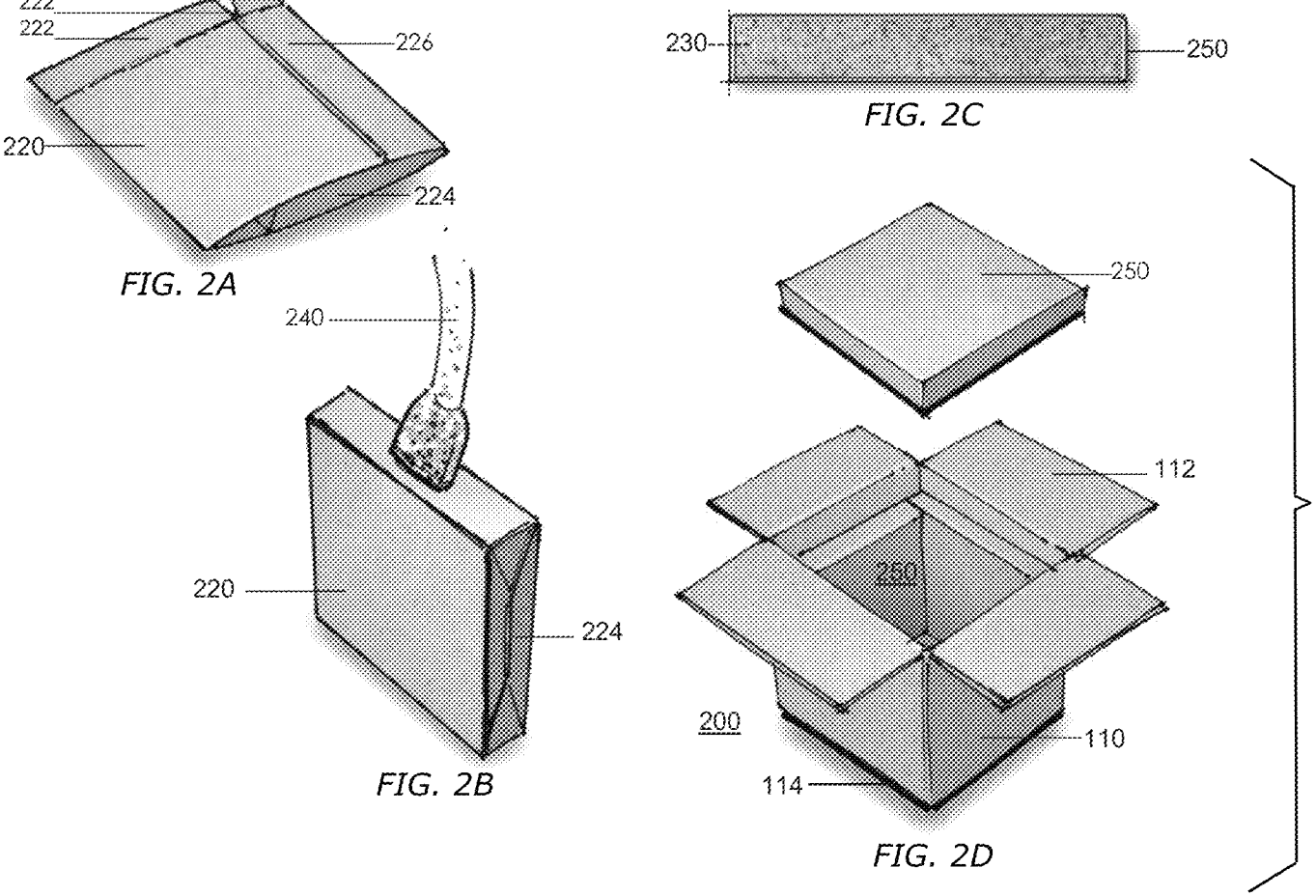
FIGS. 2A-2D show another embodiment of a cold storage container with insulation filled self-erecting box and a method of filling thereof with an insulation material in accordance with the present invention.
Figure 3C:
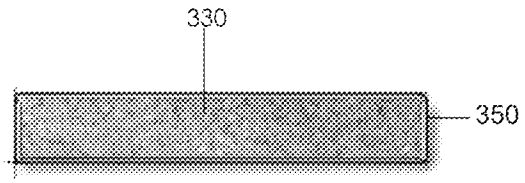
FIGS. 3A-3D show another embodiment of a cold storage container with insulation filled flat pack boxes and a method of filling thereof with an insulation material in accordance with the present invention.
Figure 3D:
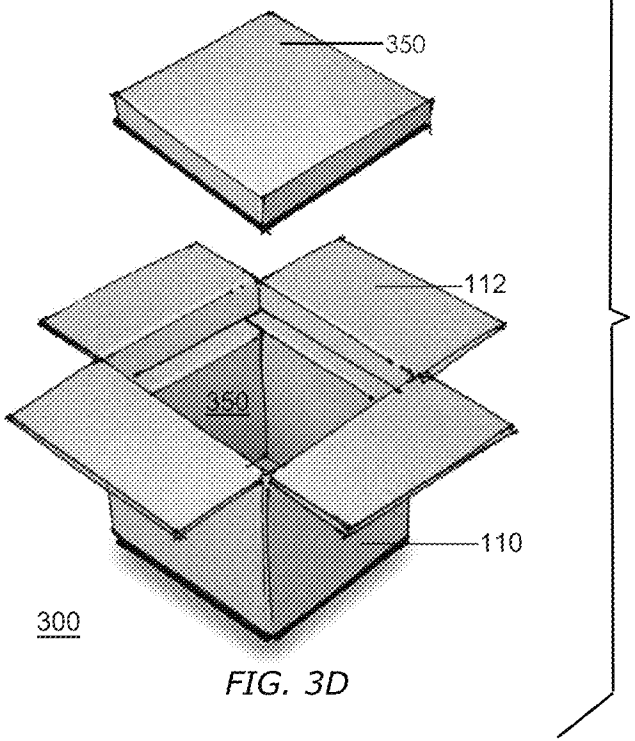
Figure 3A:
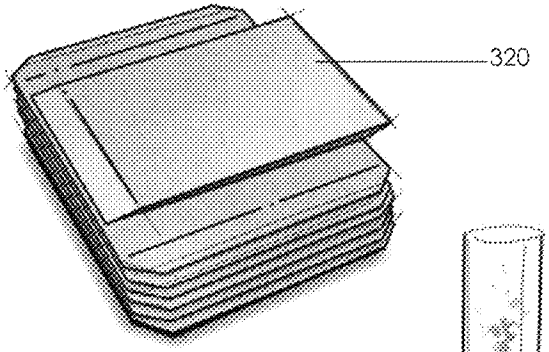
Figure 3B:
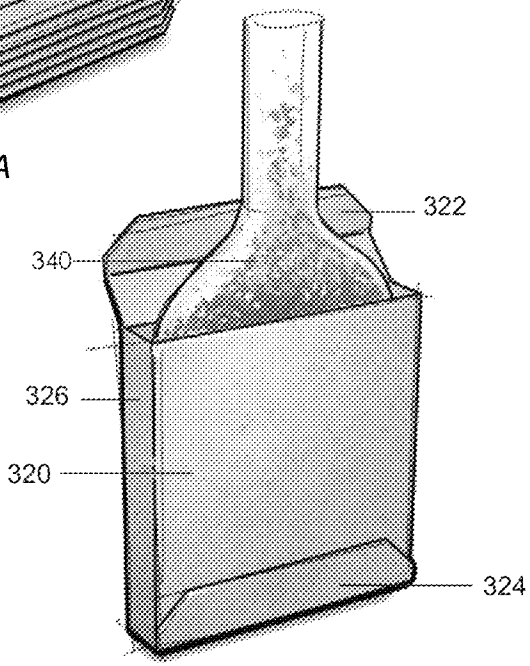
Figure 4C:
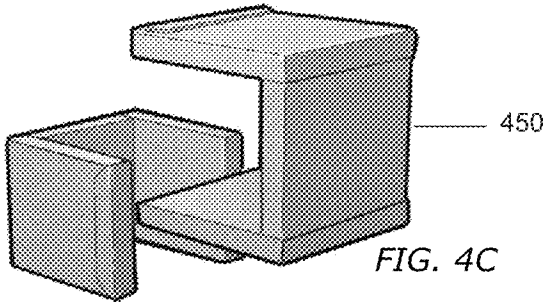
FIGS. 4A-4D show another embodiment of a cold storage container with insulation filled tri-fold panels and a method of filling thereof with an insulation material in accordance with the present invention.
Figure 4D:
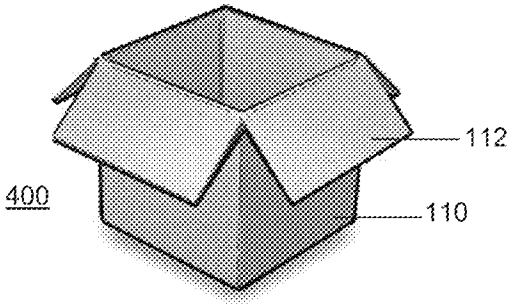
Figure 4A:
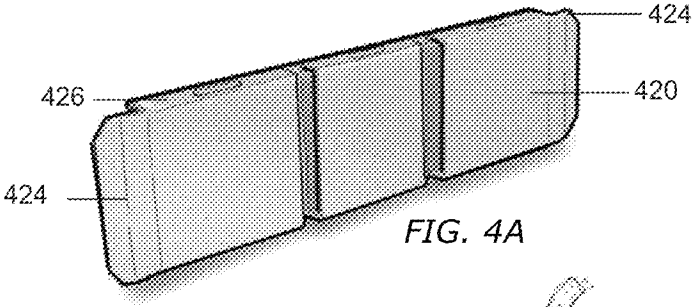
Figure 4B:
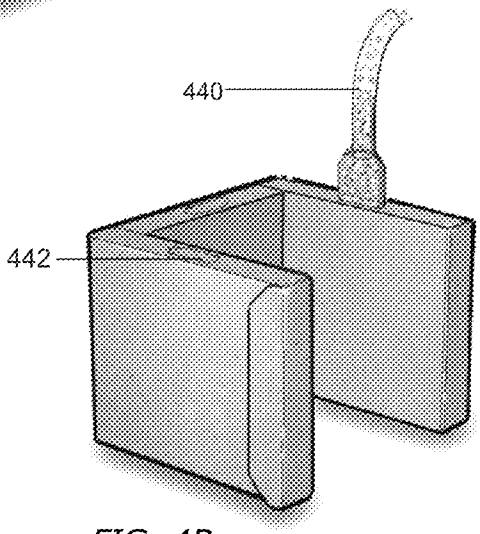
Figure 5C:
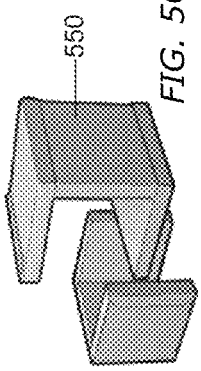
FIGS. 5A-5D show another embodiment of a cold storage container with insulation filled tri-fold panels and a method of filling thereof with an insulation material in accordance with the present invention.
Figure 5D:
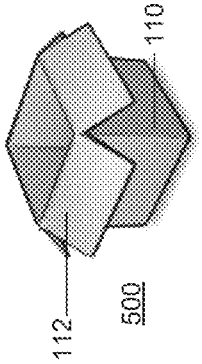
Figure 5A:
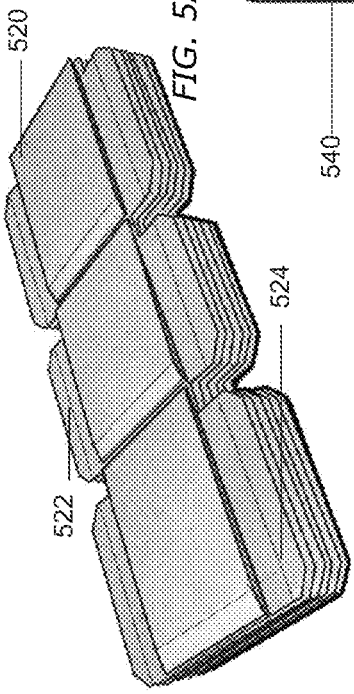
Figure 5B:
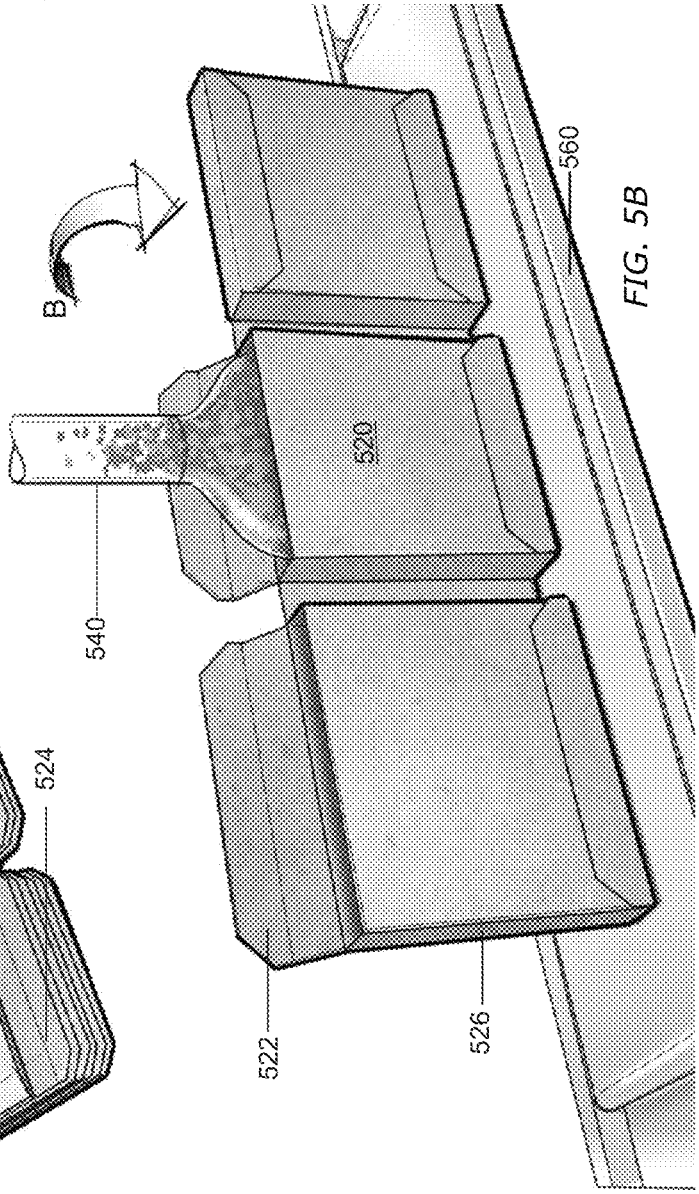

FIGS. 1A-1C show an embodiment of a cold storage container 100 in accordance with the present invention. Container 100 preferably has a "box within a box" configuration including an external box 110 and an internal box 120. External box 110 has top flaps 112 and bottom flaps 114 that are foldable to form a closed bottom of external box 110.

Internal box 120 has top flaps 122 and bottom flaps 124 that are foldable to form a closed bottom of container 120. Top flaps 122 include a gap covering section 126 and extension section 128 that is secured to a respective one of the inside walls of the external box 110 with an adhesive or other known methods commonly used in the industry. Internal box 120 is sized and configured to fit within external box 110 with a gap G between the internal box 120 and the external box 110. Gap G can be filled with an insulation material 130 to create an insulated space within container 100 suitable for cold storage and shipping of contents held within container 100. For example, the insulation material can be 100% recycled pulp such as recycled paper pulp (cellulose) and preferably has an insulation R-value per inch in the range of approximately 3.1-3.8 or example, with an R-value of 3.8 being preferred. The cellulose insulation can be inserted into gap G through a filling nozzle 140 that is part of a blow-in cellulose insulation machine.

In a preferred embodiment, container 100 is filled upside down on an assembly line with internal box 120 having bottom flaps 124 positioned to form a closed bottom of internal box 120. Internal box 120 is preferably inserted in the direction of arrow "A" into external box 110. Container 100 is then flipped upside down such that insulation material 130 can fill gap G and also at least in part cover the exterior of the bottom of internal box 120 to provide insulation between internal box 120 and the bottom of the external box 110. Bottom flaps 124 of external box 110 are closed to enclose the insulation material 130 within the container 100 within the spaces of gap G between the external box 110 and internal box 120. Insulation 130 is encapsulated into container 100 as a lightweight integrated solution.

FIGS. 2A-2D show an embodiment of a cold storage container 200 having erectable insulation filled panels in accordance with the present invention. Container 200 preferably has a configuration including an external box 110 and at least one self-erecting internal box 220 sized and shaped to fit within external box 110. Internal box 220 preferably has top flaps 222, a folded bottom 224, and side walls 226. When erected, internal box 220 has an interior space that can be filled with insulation material 230 via a fill nozzle 240 to form insulated panels 250. For example, the insulation material can be 100% recycled pulp such as recycled paper pulp (cellulose) and preferably has an insulation R-value per inch in the range of approximately 3.1-3.8 or example, with an R-value of 3.8 being preferred. The cellulose insulation can be inserted into internal box 220 though nozzle 240 that is part of a blow-in cellulose machine, via an access opening than can be formed in a side wall 226 or any of the other walls of internal box 220. Alternately, the interior of internal box 220 can be filled when top flaps 222 are open and then closed to contain insulation material 230 within internal box 220. Insulation material 230 is encapsulated into insulated panels 250 as a lightweight integrated flat pack solution. Insulated panels 250 are preferably arranged within external box 110 along one or more of the sides, top, and bottom of external box 110 to form an insulated space surrounded by insulated panels 250.

FIGS. 3A-3D show an embodiment of a cold storage container 300 having insulation filled flat pack boxes in accordance with the present invention. Container 300 preferably has a configuration including an external box 110 and at least one flat pack internal box 320 sized and shaped to fit within external box 110. Internal box 320 preferably has top panel 322, a bottom panel 324, and side walls 326. When folded into a box configuration, internal box 320 has an interior space that can be filled with insulation material 330 via a fill nozzle 340 to form insulated panels 350. For example, the insulation material can be 100% recycled pulp such as recycled paper pulp (cellulose) and preferably has an insulation R-value per inch of 3.1 or higher, and preferably in the range of approximately 3.1-3.8 for example, with an R-value of 3.8 being preferred. The cellulose insulation can be inserted though nozzle 340 that is part of a blow-in cellulose insulation machine into internal box 320 via an access opening than can be formed in a side wall 226 or any of the other walls of internal box 320. Alternately, the interior of internal box 320 can be filled when top panel 322 is open and then closed to contain insulation material 330 within internal box 320. Insulated panels 350 are preferably arranged within external box 110 along one or more of the sides, top, and bottom of external box 110 to form an insulated space surrounded by insulated panels 350.

FIGS. 4A-4D show an embodiment of a cold storage container 400 having insulation filled tri-fold panels in accordance with the present invention. Container 400 preferably has a configuration including an external box 110 and at least one self-erecting internal panel 420 sized and shaped to fit within external box 110. Internal panel 420 preferably has end flaps 424, and side walls 426. When erected, internal panel 420 has an interior space that can be filled with insulation material 430 via a fill nozzle 440 to form insulated panels 450. For example, the insulation material can be 100% recycled pulp such as recycled paper pulp (cellulose) and preferably has an insulation R-value per inch of approximately 3.1 or higher and preferably in the range of approximately 3.1-3.8 for example, with an R-value of 3.8 being preferred. The cellulose insulation can be inserted though nozzle 440 that is part of a blow-in cellulose machine into internal panel 420 via an access opening 442 that can be formed in a side wall 426 or any of the other walls of internal panel 420. Alternately, the interior of internal panel 420 can be filled when end flaps 424 are open and then closed to contain insulation material 430 within internal panel 420. A first set of insulated panels 450 are preferably arranged in a U-shaped configuration within external box 110 along one or more of the sides, top, and bottom of external box 110 to form an insulated space surrounded by insulated panels 450. A second set of insulated panels 450 can be inserted into external box 110 arranged in a U-shaped configuration within external box 110 along one or more of the sides, top, and bottom of external box 110 not occupied by the first set of insulated panels 450 to further surround and fully enclose the insulated space.

FIGS. 5A-5D show an embodiment of a cold storage container 500 having insulation filled tri-fold panels in accordance with the present invention. Container 500 preferably has a configuration including an external box 110 and at least one internal trifold-panel 520 sized and shaped to fit within external box 110. Internal panel 520 is preferably formed from card stock boxes. Internal panel 520 preferably has multiple box sections, each box section preferably having end flaps 522 and end flaps 524, and side walls 526. When erected, internal panel 520 has an interior space that can be filled with insulation material 530 via a fill nozzle 540 to form insulated panels 550. For example, the insulation material can be 100% recycled pulp such as recycled paper pulp (cellulose) and preferably has an insulation R-value per inch of approximately 3.1 or higher and preferably in the range of approximately 3.1-3.8 for example, with an R-value of 3.8 being preferred. The interior of the box section of internal panel 520 can be filled when top end flaps 522 are open to be accessed by fill nozzle 540, filled with insulation 530, and then closed in the direction of arrow B to contain insulation material 530 within internal panel 520. Alternatively, the cellulose insulation material can be inserted into internal panel 520 via an access opening that can be formed in a side wall 526 or any of the other walls of internal though nozzle 540 that is part of a blow-in cellulose machine. The filling operation can be automated and performed on an assembly line 560 as part of the box manufacturing operation.

Insulated panels 550 are preferably arranged within external box 110 along one or more of the sides, top, and bottom of external box 110 to form an insulated space surrounded by insulated panels 550. A second set of insulated panels 550 can be inserted into external box 110 arranged in a U-shaped configuration within external box 110 along one or more of the sides, top, and bottom of external box 110 not occupied by the first set of insulated panels 550 to further surround and fully enclose the insulated space.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the broad scope of the disclosure.

The foregoing outlines features of several embodiments so that those of ordinary skill in the art may better understand various aspects of the present disclosure. Those of ordinary skill in the art should appreciate that they may readily use the present disclosure as a basis for designing or modifying other processes and structures for carrying out the same purposes and/or achieving the same advantages of various embodiments introduced herein. Those of ordinary skill in the art should also realize that such equivalent constructions do not depart from the spirit and scope of the present disclosure, and that they may make various changes, substitutions, and alterations herein without departing from the spirit and scope of the present disclosure.

Various operations of embodiments are provided herein. The order in which some or all of the operations are described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application and the appended claims are generally be construed to mean "one or more" unless specified otherwise or clear from context to be directed to a singular form. Also, at least one of A and B and/or the like generally means A or B or both A and B. Furthermore, to the extent that "includes", "having", "has", "with", or variants thereof are used, such terms are intended to be inclusive in a manner similar to the term "comprising". Also, unless specified otherwise, "first," "second," or the like are not intended to imply a temporal aspect, a spatial aspect, an ordering, etc. Rather, such terms are merely used as identifiers, names, etc. for features, elements, items, etc. For example, a first element and a second element generally correspond to element A and element B or two different or two identical elements or the same element.

Also, although the disclosure has been shown and described with respect to one or more implementations, equivalent alterations and modifications will occur to others of ordinary skill in the art based upon a reading and understanding of this specification and the annexed drawings. The disclosure comprises all such modifications and alterations. In particular regard to the various functions performed by the above described features (e.g., elements, resources, etc.), the terms used to describe such features are intended to correspond, unless otherwise indicated, to any features which performs the specified function of the described features (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

The invention claimed is:

1. An insulated container for transporting temperature sensitive contents, the container comprising:

an external box having sides with an upper portion and a lower portion, a top extending from a juncture at the upper portion of the sides, and a bottom extending from a junction at the lower portion of the sides; and an internal box having sidewalls, a bottom, and extensions extending from the sidewalls, the sidewalls of the internal box surrounding an internal space for holding the contents, the internal box being sized and configured to be inserted and contained within the external box, the extensions being positioned proximate the juncture of the top and the upper portion of the sides of the external box, wherein, when the internal box is inserted within the external box, gaps are present between the sides of the external box and the sidewalls of the internal box, and a bottom space is present between the bottom of the internal box and the bottom of the external box, the gaps and the bottom space being filled with a loose- fill insulation material being formed of separated particles to create an insulated space between the sides of the external box and the sidewalls of the internal box surrounding at least a portion of the internal space of the internal box, the loose-fill insulation being a blow-in insulation that is blown into the gaps through a filling nozzle from a blow-in cellulose insulation machine, the extensions of the internal box extending over the gaps between the side walls proximate the top of the external box forming a closed perimeter over the gaps between the external box and the side walls of the internal box.

2. The insulated container of claim 1, wherein the loose-fill insulation comprises recycled pulp.

3. The insulated container of claim 1, wherein the loose-fill insulation has an insulation R-value per inch in the range of approximately 3.1-3.8.

4. An insulated container for transporting temperature sensitive contents, the container comprising:

an external box having sides, a top, and a bottom; and a plurality of insulated panels, each of the insulated panels having a top, a bottom, and spaced apart sidewalls defining an interior space therebetween, each of the insulated panels being sized and configured to be inserted and contained within the external box, the interior space being filled with a loose-fill insulation material between the sidewalls, the loose-fill insulation being a blow-in insulation formed of separated particles configured to be blown into and fill the interior space through a filling nozzle from a blow-in cellulose insulation machine; and a filling port, the loose-fill insulation material being filled through the filling port and into the interior space defined by the spaced apart insulation panels, wherein, when the insulated panels are inserted within the external box, the insulated panels with the interior space filled with the insulation material are arranged along the sides, top, and bottom of the external box, respectively, to create an insulated space defining a cargo hold for holding the temperature sensitive contents.

5. The insulated container of claim 4, wherein at least three of the insulated panels are connected to form a tri-fold panel.

6. The insulated container of claim 5, wherein the loose-fill insulation comprises recycled pulp.

7. The insulated container of claim 4, wherein the loose-fill insulation has an insulation R-value per inch in the range of approximately 3.1-3.8.

* * * * *